US011052428B2

(12) United States Patent
Landwehr et al.

(10) Patent No.: US 11,052,428 B2
(45) Date of Patent: Jul. 6, 2021

(54) SNAP IN SCREEN AND METHOD

(71) Applicant: M-I L.L.C., Houston, TX (US)

(72) Inventors: Mitchell Landwehr, Villa Hills, KY (US); Benjamin Holton, Covington, KY (US); John Fedders, Union, KY (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 171 days.

(21) Appl. No.: 16/455,698

(22) Filed: Jun. 27, 2019

(65) Prior Publication Data

US 2020/0406301 A1 Dec. 31, 2020

(51) Int. Cl.
*B07B 1/46* (2006.01)
*B07B 1/36* (2006.01)

(52) U.S. Cl.
CPC ..... *B07B 1/4681* (2013.01); *B07B 1/36* (2013.01); *B07B 2201/02* (2013.01)

(58) Field of Classification Search
CPC ..... B07B 1/4681; B07B 1/36; B07B 2201/02
USPC ..... 209/400
See application file for complete search history.

(56) References Cited

U.S. PATENT DOCUMENTS

| | | | | |
|---|---|---|---|---|
| 4,732,670 | A | 3/1988 | Nelson | |
| 8,827,080 | B2 | 9/2014 | Holton | |
| 9,180,493 | B2 * | 11/2015 | Dahl | B07B 1/4672 |
| 2006/0219608 | A1 * | 10/2006 | Scott | B01D 33/0376 209/406 |
| 2012/0273398 | A1 | 11/2012 | Wiseman | |
| 2014/0124417 | A1 * | 5/2014 | Holton | B07B 1/46 209/412 |
| 2016/0207069 | A1 * | 7/2016 | Pomerleau | B07B 1/46 |
| 2018/0071782 | A1 | 3/2018 | Takev | |
| 2018/0193882 | A1 | 3/2018 | Wojciechowski | |

OTHER PUBLICATIONS

International Search Report and Written Opinion issued in International Patent application PCT/US2020/038161 dated Oct. 5, 2020, 11 pages.

* cited by examiner

*Primary Examiner* — Terrell H Matthews

(57) ABSTRACT

A method of installing a vibratory shaker screen in a vibratory shaker, including placing a first end of the vibratory shaker screen in a retainer, wherein the retainer is a component of the vibratory shaker; pivoting a second end of the vibratory shaker screen toward a screen installation position on the vibratory shaker, deflecting a tab on one of the vibratory shaker screen and the vibratory shaker through contact of the vibratory shaker screen to another retainer of the vibratory shaker, and connecting the vibratory shaker screen to the vibratory shaker, where the tab fixedly connects the vibratory shaker screen to the vibratory shaker.

22 Claims, 8 Drawing Sheets

SNAP IN SCREEN AND METHOD

BACKGROUND

In certain industries and/or applications, the separation of a first material from a second material is desired and/or required. In addition to separating a first material from a second material, separating solids from fluids is a common occurrence in an array of industries. For example, industrial separators use screens to separate solid materials from fluids. In one instance, the mining industry uses screens to separate solid materials from fluids in order to extract a desired ore during the mining process. In another instance hydrocarbon recovery drilling operations may use a variety of equipment to separate solid materials, such as cuttings created by a drill bit, from fluids, such as drilling fluids, throughout the drilling processes.

Conventional vibratory shakers are used to separate materials in different processes. Screen designs that fit within vibratory shakers generally require a specific geometry that allows for both ends of the screen to attach and detach from the shaker. One such embodiment, called a hook-strip screen, has multiple layers of mesh fused together. A screen tension is created during the mounting process to the shaker and the tension may be increased or decreased after the screen is installed. In some embodiments, opposite sides of the screen provide a hook-strip arrangement formed by a turn-back element. The hook-strip may be attached to a tension rail, which is fixed to an internal side wall of the vibratory shaker. A tension bolt is then used to secure the hook-strip to the shaker.

Throughout the lifetime of the screen, particles cause wear to the wire mesh in the screen. As a result of this wear, a damaged or worn area of mesh will allow larger than desired particles to pass through the screen. Over time, screens must be replaced after this damage occurs. The replacement of these screens is costly and there is a need to provide a screen design that may be easily installed in vibratory shakers.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure, and are therefore not to be considered limiting of its scope, for the disclosure may admit to other equally effective embodiments without specific recitation. Accordingly, the following summary provides just a few aspects of the description and should not be used to limit the described embodiments to a single concept.

In one embodiment, a method of installing a vibratory shaker screen in a vibratory shaker is disclosed. The method may comprise placing a first end of the vibratory shaker screen in contact with a first retainer of the vibratory shaker. The method may further comprise pivoting a second end of the vibratory shaker screen toward a screen installation position on the vibratory shaker. The method may still further comprise deflecting a tab on the vibratory shaker screen through contact of the vibratory shaker screen to a second retainer of the vibratory shaker during the pivoting. The method may also comprise connecting the vibratory shaker screen to the vibratory shaker, wherein the tab is positioned into a non-deflected position in contact with the second retainer such that the vibratory shaker screen is fixedly attached to the vibratory shaker.

In another embodiment, a vibratory shaker screen is disclosed. The vibratory shaker screen may comprise a mesh supporting system with at least one tab configured to move from an un-deflected position to a deflected position. The screen may also be configured wherein the at least one tab is configured to move to the deflected position upon placement of a force on the tab and wherein the tab is configured to return to the un-deflected position upon removal of the force. The shaker screen may also comprise at least one mesh portion placed on the mesh supporting system.

In another embodiment, a vibratory shaker screen is disclosed. The screen may comprise a mesh supporting system configured with a frame and at least one side of the frame has at least one tab and wherein the tab has an un-deflected position and a deflected position. The vibratory shaker screen may be configured wherein each of the at least one tab is configured to deflect upon placement of a force upon the tab and wherein the tab is configured to return to the un-deflected position upon removal of the force and wherein the mesh supporting system has a top face and a bottom face. The vibratory shaker screen may further comprise a first mesh portion connected to the top face of the mesh supporting system. The vibratory shaker screen may also comprise a second mesh portion connected to the bottom face of the mesh supporting system.

In another embodiment a method of installing a vibratory shaker screen in a vibratory shaker is disclosed. The method may comprise placing a first end of a vibratory shaker screen in contact with a vibratory shaker. The method may further comprise placing a second end of the vibratory shaker screen in contact with the vibratory shaker. The method may also comprise applying a force onto the vibratory shaker screen to deflect at least one tab on one of the vibratory shaker screen and the vibratory shaker. The method may further comprise connecting the vibratory shaker screen to the vibratory shaker, wherein the at least one tab is positioned into a non-deflected position such that the vibratory shaker screen is fixedly attached to the vibratory shaker.

Other aspects and advantages will become apparent from the following description and the attached claims.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure, and are therefore not be considered limiting of its scope, for the disclosure may admit to other equally effective embodiments.

Figure 1:
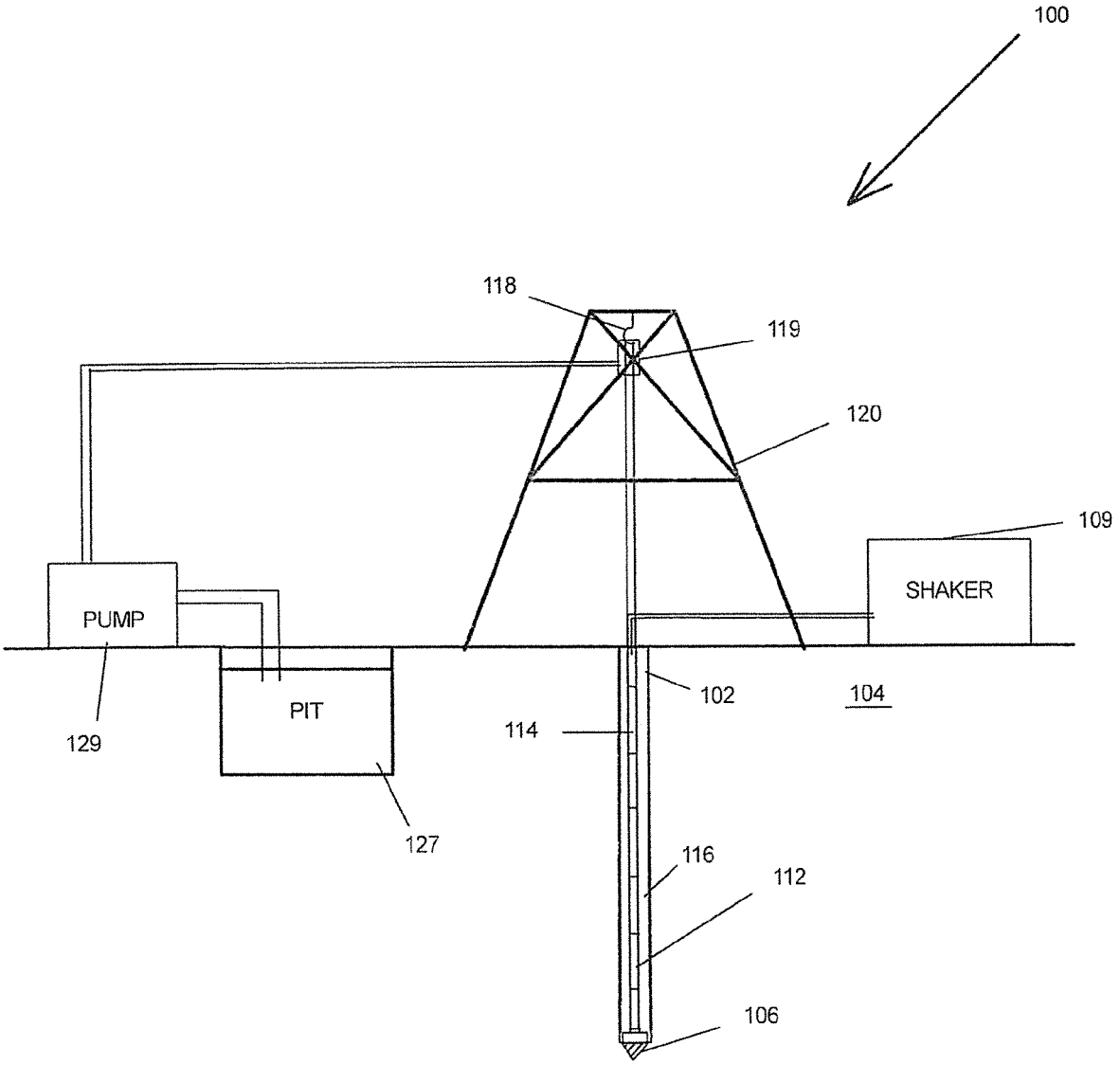
FIG. 1 is a view of a drilling rig performing a drilling operation for hydrocarbon recovery, according to one or more embodiments of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims, except where explicitly recited in a claim. Likewise, reference to "the disclosure" shall not be construed as a generalization of inventive subject matter disclosed herein and shall not be considered to be an element or limitation of the claims except where explicitly recited in a claim.

Although the terms first, second, third, etc., may be used herein to describe various elements, components, regions, layers, and/or sections, these elements, components, regions, layers and/or sections should not be limited by these terms. These terms may be only used to distinguish one element, component, region, layer, or section from another region, layer, or section. Terms such as "first", "second" and other numerical terms when used herein do not imply a sequence or order unless clearly indicated by the context. Thus, a first element, component, region, layer, or section discussed herein could be termed a second element, component, region, layer, or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

In one aspect, embodiments herein relate to a filtering assembly or screen design to be used with a vibratory shaker. In some embodiments, where it is desired to maximize the amount of screening capability on a linear measure basis, the screen designs disclosed may be altered, to provide a screening surface area different than shown in the FIGS. In the embodiments described below, the disclosure relates to oil and gas drilling. The drilling and subsequent mechanical separation functions may be performed on land or at sea. In the illustrated embodiment, a land based operation is described.

In these embodiments, a vibratory shaker screen is provided that is economical to install and uninstall compared to conventional screens, such as hook-strip screens. Contrary to components in conventional systems, the screening technology used in the vibratory shaker screen described herein requires only minimal mechanical skills of an operator for screen installation within a vibratory shaker. In embodiments described, installation occurs when tabs on the vibratory shaker screen "snap" into place underneath or into a retainer provided on the vibratory shaker and a mechanical engagement between the screen and the shaker is established. Removal of the vibratory shaker screen may occur when the tabs are deflected, and the mechanical engagement is disengaged. Conventional vibratory shaker screens require complex tools to allow for establishment of a mechanical connection between the vibratory shaker screen and the vibratory shaker. While conventional vibratory shaker screens may perform adequately under service conditions, operators are challenged to provide a connection that is sufficiently strong to withstand expected forces from the vibratory shaker. As the installation of conventional screens can be difficult, operators use extreme care during the installation of screens. Such installation techniques take time and are costly.

Vibratory shakers come in many sizes, and therefore, more than one single vibratory shaker screen is used in the hydrocarbon recovery industry. Problems are encountered when multiple vibratory shaker screens must be changed by operators. Vibratory shaker screens can be heavy, as they are made of metallic components, and affixing the vibratory shaker screens to a vibratory shaker often requires numerous hand tools to establish a mechanical connection. When multiple vibratory shaker screens must be replaced, the vibratory shaker is unavailable for processing, impacting the overall economics of drilling operations. Embodiments described herein, including both methods and apparatus, resolve these concerns by drastically reducing the installation and maintenance costs of screening technology. Embodiments herein also relieve constraints for improper installation of vibratory shaker screens as the connection system is incorporated into the vibratory shaker screen itself. With a minimization of rotary parts required for screen installation, as well as an elimination of installation tools, the method of installing the described vibratory shaker screen to the vibratory shaker is quicker, easier, and less prone to error compared to conventional systems.

An example drilling rig is described for identification of the components described in relation to the vibratory shaker, as well as the methods used for screen installation within the vibratory shaker system. In this context, aspects of the disclosure may relate to shale shaking screens. Use of the technology in the following disclosure may be used in elliptical or linear motion shaker systems. In the illustrated embodiment, a metal screen is disclosed. Other embodiments are possible. Aspects of the disclosure may be used in plastic composite steel frame screens, rock shaker screens, double deck screens as well as more complex screens such as wave configuration screens. Although described as being applicable to a vibratory shaker that is used in hydrocarbon recovery drilling rigs, a person of skill in the art will recognize that other types of systems may also benefit from the arrangements described. In one embodiment, vibratory shakers are used in the processing of mining materials, where separation of different size solid components is necessary. In other embodiments, aspects of the disclosure may be used to install screens on electrodynamic shakers for processing of bulk materials. Screening technology used in chutes, silos and hoppers may also use this technology where maintenance of screening is an important, but costly, task that must be performed by operators. In other processing, screening technology used in food and the pharmaceutical industry can use such a technology, therefore the description of applicability to drilling rigs is merely illustrative.

Referring to FIG. 1, an example drilling rig 100 is illustrated. The drilling rig 100 is used to obtain hydrocarbons from reserves located beneath the surface of the ground. In order to obtain these hydrocarbons, a wellbore 102 is created within an earth stratum 104. Penetration into the stratum 104 is achieved through use of a drill bit 106. The drill bit 106 is made of rugged material, such as a metallic rotary head that has diamonds impregnated within the surface for the purpose of grinding materials within the earth stratum 104. Rotary motion of the drill bit 106 cuts materials ("cuttings") at the bottom of the wellbore 102 that are to be removed. To remove such cuttings/materials, water and/or chemicals are pumped down a drill string 112 and exit ports in the drill bit 106. The water/chemicals lift the cuttings up an annular area 116.

As the industry wishes to recover the hydrocarbons in the most efficient manner possible, the water/chemicals are desired to be re-used. The water/chemicals should then be separated from the cuttings by a vibratory shaker 109. The processing of the water/chemicals can take several forms, including use of the vibratory shaker 109 and a hydrocyclone (not shown) to separate heavier materials from lighter materials.

In a progression of drilling, individual sections of drill string pipe 114 are connected to one another at joints to allow fluids to be safely conveyed to the drill bit 106 downhole. As illustrated, the drill bit 106 is configured such that the overall width of the drill bit 106 is slightly larger than the drill string 112, thus creating an annular area 116 between an exterior surface of the drill string 112 and the inner surface of the wellbore 102. The vibratory shaker 109 may be used with other systems, such as hydocyclones, to separate materials from the water/chemical mixture. The vibratory shaker 109 may be a single or multiple deck type of shaker apparatus. Hydrocyclones may be used prior to or post screening operations, as needed.

To lengthen the drill string 112, subsequent sections of drill string pipe 114 may be added to the drill string 112 by using a crane 118 placed on a derrick 120. A connection between the section of drill string pipe 114 being added and the drill string 112 is established through rotation of the section of pipe 114 being added. Once a connection is established, the drill string 112 may be further pushed into the stratum 104 until a further section of pipe is needed. A driving mechanism, such as a top drive or a rotary table may be disconnected from the drill string 112, a new section of pipe 114 may be added, and rotation of the drill string 112 and attached drill bit 106 may continue.

Although illustrated as a straight wellbore 102 (i.e., vertical orientation), the wellbore 102 may deviate from the vertical orientation. The amount of deviation may be chosen by operators in order to achieve penetration of different sections of stratum 104. In some embodiments, the wellbore 102 may be horizontally positioned to maximize an amount of the wellbore 102 to a specific stratum 104 where a hydrocarbon reserve is located. The wellbore 102 may then travel along the hydrocarbon reserve for maximum recovery of hydrocarbons. The directional control of the drill string 112 may be though a rotatable steering system ("RSS") that may either push the drill bit 106 or point the drill bit 106 a specific direction to achieve a desired angle of stratum 104 penetration.

Drilling fluid or "mud" may be stored in a pit 127 or tank located at the wellsite. In another embodiment, a pump 129 delivers the drilling fluid to a port in a swivel 119 causing the fluid to flow downwardly through the drill string 112 and, consequently, transporting cuttings to the surface in the annular area 116. Other types of treatments to the water/chemical mixture are possible. Although described as a pit 127, other configurations for storing drilling fluid may comprise use of a single or multiple tanks. Mixing of the drilling fluids used in operations may be determined by operators based upon the soil characteristics of the stratum 104 encountered.

In the embodiments illustrated in FIGS. 2-8, drilling fluid may include specialty chemicals, such as emulsifiers and wetting agents, flocculants, defoamers and corrosion inhibitors used in the drilling process and solids that may be transported to the up-hole environment and processed through the vibratory shaker 109. Processing of the drilling fluid can occur through a vibratory shaker 109 and a mud cleaner that provides for high efficiency solids removal and fluids preservation for the entire circulating volume.

Figure 2:
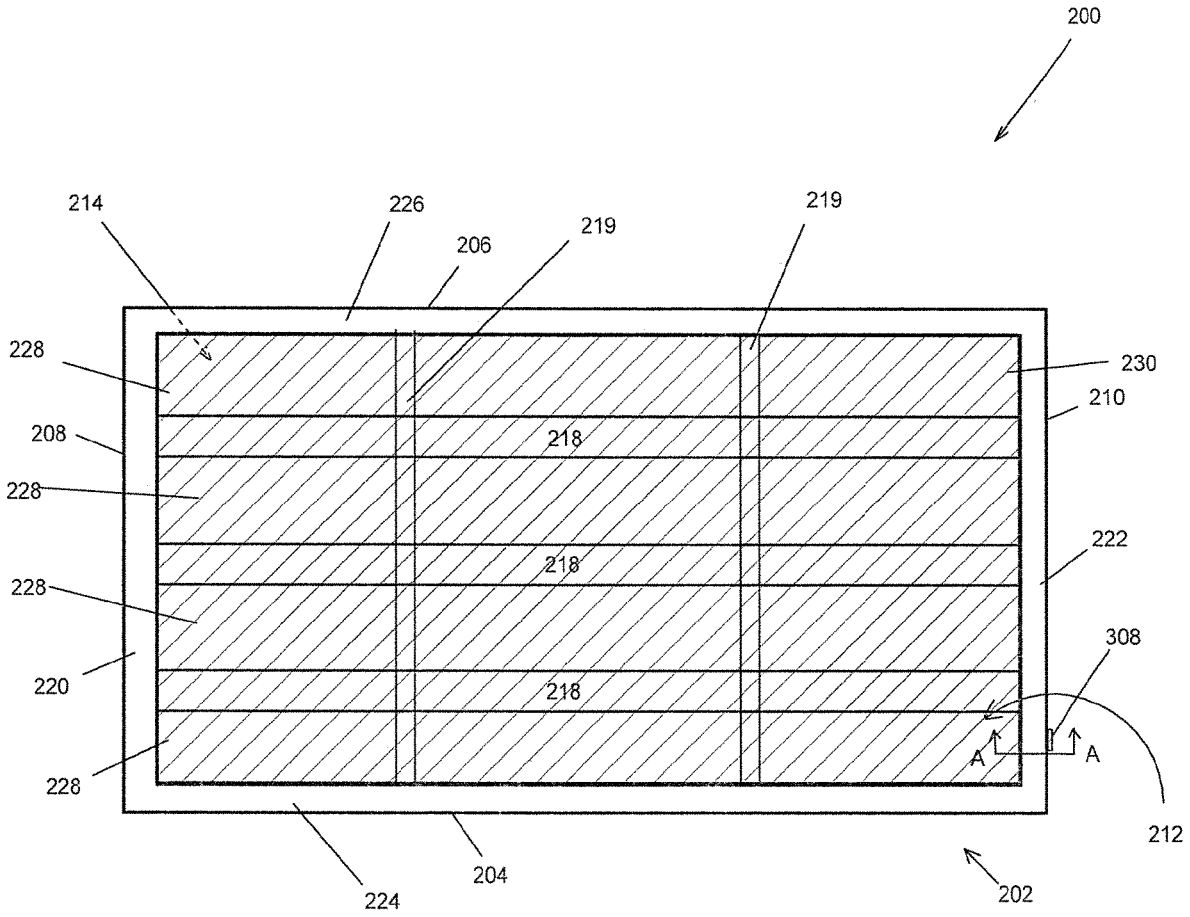
FIG. 2 is a plan view of a vibratory shaker screen used in a shaker of FIG. 1, according to one or more embodiments of the disclosure.
Figure 3:
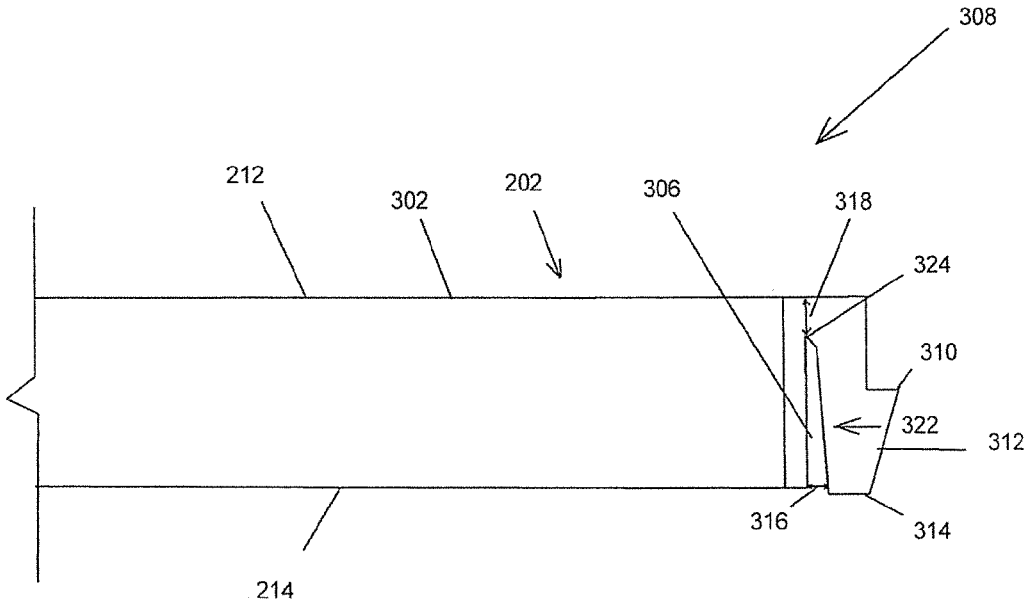
FIG. 3 is a side view of the vibratory shaker screen of FIG. 2.

In one embodiment, referring to FIG. 2, a vibratory shaker screen 200 is disclosed. The vibratory shaker screen 200 may be used within the vibratory shaker 109 of FIG. 1. The vibratory shaker screen 200 includes a mesh supporting system 202. The vibratory shaker screen 200 is configured to extend between retainers 500 (FIG. 5) of the vibratory shaker 109. The mesh supporting system 202 may be a frame or housing. The mesh supporting system 202 may be constructed of metal (e.g. steel, aluminum, etc.), thermoset polymeric material, thermoplastic polymeric material, a reinforced composite material, or any other suitable material. The mesh supporting system 202, in the instance of metal being used, may be of a welded construction to provide for durability of anticipated acceleration loadings created by the vibratory shaker 109. Vibratory shaker screens 200 may be sized to cover an entire area inside a vibratory shaker 109 or may be made in smaller sub-sections that can each be replaced. Advantages of small dimensional vibratory shaker screens 200 include lighter weight for operators to handle, and the ability to change or replace smaller sections of screening systems, which minimizes waste. In other embodiments, the frame may form portions of a tab 308 (FIG. 3). In these embodiments, sections of the mesh supporting system 202 may be removed, leaving at least one tab 308 extending from the mesh supporting system 202. In other embodiments, at least one tab 308 may be welded to the exterior side surface of the mesh supporting system 202, thereby allowing a quick and efficient production of the vibratory shaker screen 200. Tabs 308 may be located on any member, such as side members 204, 206, 208 or 210. For ease of description, installation of a vibratory shaker screen 200 will be discussed below with installation of the screen in or at a first end 220 and subsequent rotation of the vibratory shaker screen 200 to an installed positon, wherein a tab 308 located at a second end 222 of the screen 200.

The mesh supporting system 202 is attached to the internal portion of the vibratory shaker 109. The mesh supporting system 202 is configured with four side members 204, 206, 208, 210, a top face 212, and a bottom face 214. The four side members 204, 206, 208, 210 define an exterior perimeter of the mesh supporting system 202. The profile of the top face 212 and bottom face 214 are planer in FIG. 2 but may be other shapes. The top face 212 and bottom face 214 may have a convex, concave, or an irregular shape, such as a wave shape. The mesh supporting system 202 may have structural elements, such as ribs, that add structural rigidity to the mesh supporting system 202.

The top face 212 and the bottom face 214 may be connected through supports 218 that extend from the top face 212 to the bottom face 214. In the illustrated embodiment, the structural supports 218 are perpendicular to the top face 212 and bottom face 214; however, the structural supports 218 may be located at an angle, thereby connecting different "x" coordinate positions on the mesh supporting system 202. The structural supports 218 may be constructed from flat plate steel, thereby limiting the amount of screening surface area interrupted by the structural support 218.

The structural supports 218 may run from the first end 220 to the second end 222. Other structural supports 219 may run from a third end 224 to a fourth end 226. Support, therefore, may be provided throughout the mesh supporting system 202. Ends of the mesh supporting system 202 may include a tubular frame for rigidity for expected loads from the vibratory shaker 109. In an embodiment using relatively short screens, structural supports 218, 219 may be omitted as the mesh supporting system 202 may have sufficient rigidity to withstand loading.

Each vibratory shaker screen 200 may include multiple screening segments 228. These screening segments 228 extend over sections of the vibratory shaker screen 200. In one embodiment, a single screening segment 228 may be used. If wider areas are required to be screened, then multiple screening segments 228 may be used. As screening may extend on the top face 212 and the bottom face 214, two different levels of screening capability may be provided on a single screen 200. These different levels of screening capability may vary according to a type of mesh 230 that is used or the different levels may use the same type of mesh 230. Two different mesh sizes may be used for the top face 212 as opposed to the bottom face 214. In other embodiments, the mesh supporting system 202 supports the top face 212 and the bottom face 214, and the mesh portions for the top face 212 and the bottom face 214 may be made of differing materials. The top face 212 and the bottom face 214 may also be made into more complex geometries. In one embodiment, the top face 212 may provide a triangular form, while the bottom face 214 may provide a planar configuration.

In still other embodiments, a complex support system may be provided for the top face 212, wherein a single layer of mesh 230 covers a wave form shape, wherein peaks and valleys of the mesh 230 extend toward the front face 212 and the back face 214. Such a shape provides for greater sifting capability per square unit measurement as the amount of mesh exposed to material is greater than that exposed in a flat system. As will be understood, the mesh 230 may cover the entire vibratory shaker screen 200 in a single portion, or a different number of sections (portions) may be used.

Figure 5:
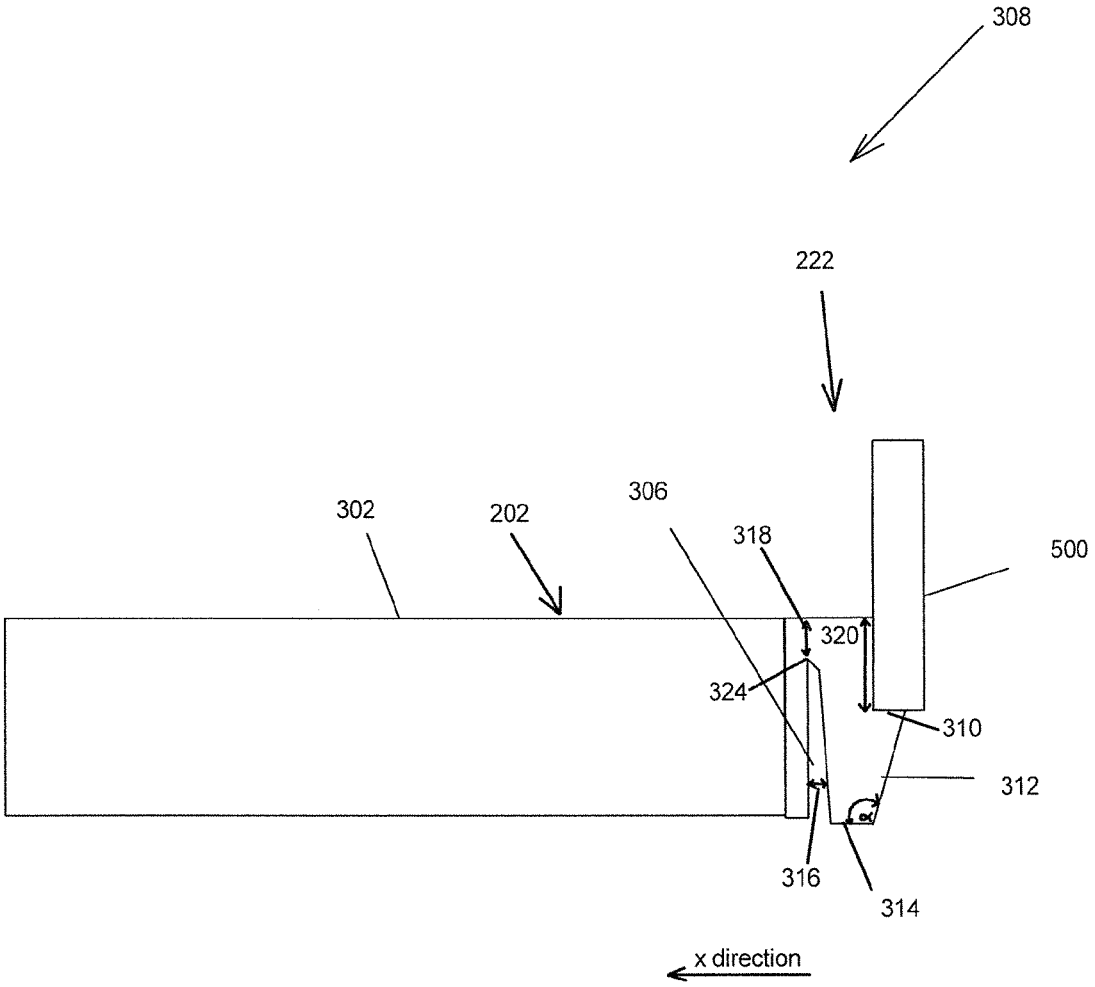
FIG. 5 is a side view of the vibratory shaker screen of FIG. 3 in an installed position.

Referring to FIG. 3, the mesh supporting system 202 of FIG. 2 is illustrated along section A-A. Areas around a tab 308 of FIG. 2, on side member 210, are illustrated. The purpose of the tab 308 is to provide a mechanical connection between the mesh supporting system 202 and a vibratory shaker 109. To accomplish this, the tab 308 is designed to deflect in direction 322 when a force is placed on the angled surface 312. Such force is exerted when the mesh supporting system 202 is rotated into an installed position. The size of the mesh supporting system 202 is such that the overall length of the mesh supporting system 202 extends from inner surfaces of the vibratory shaker 109 and the tab lock surface 310 fits underneath a retainer 500 (illustrated in FIG. 5) positioned on the vibratory shaker 109. In the configuration of FIG. 5, the tab 308 is placed under the retainer 500 of the vibratory shaker 109. In one embodiment, the mesh supporting system 202 is configured of a metal, such as stainless steel, aluminum, A36 carbon steel. The metal of the tab 308 is configured to deflect around a pivot point 324 located at a top of a deflection area 316. As will be understood, the deflection area 316 can be increased or decreased in size to allow greater or lesser amounts of deflection for the tab 308. In other embodiments, a gap 306 provided for the screen may have a greater overall length, moving the pivot point 324 upward, allowing for greater deflection of the tab 308 toward the left of FIG. 3. For installation of a vibratory shaker screen 200 in a vibratory shaker 109 with a very high "g" loading, the amount of material present in the tab connection area 318 is increased compared with processes that do not desire to have as high a force loading. The stiffer connection of the tab 308 in these instances, provide for more resistance to bending and sheer that will be experienced by the vibratory shaker screen 200 during loading. In another embodiment, the tab may be a mechanical device or lever with a spring to perform the same function.

An angled surface 312 is provided such that rotation of the mesh supporting system 202 into the installation position, illustrated and described causes contact between a retainer 500 and the angled surface 312 and not between the retainer 500 and the bottom edge 314. Such an installation position will allow the lock surface 310 to engage the retainer 500 located on the vibratory shaker 109. By having the length of the mesh supporting system 202 defined by the amount of open top surface 302 along the top face 212 that extends between retainers 500 on the vibratory shaker 109, the greater amount of projection of the tab 308 will allow for contact between the retainer 500 on the vibratory shaker 109 and the angled surface 312 and prevent jamming if contact between the bottom edge 314 and the retainer 500 were to occur. As will be understood, each of the tabs 308 may be constructed from a flexible material such that a mechanical connection may be established without permanently deforming the tab 308. Highly ductile materials such as aluminum or steel may be used to provide for rigidity and long service life.

Figure 4:
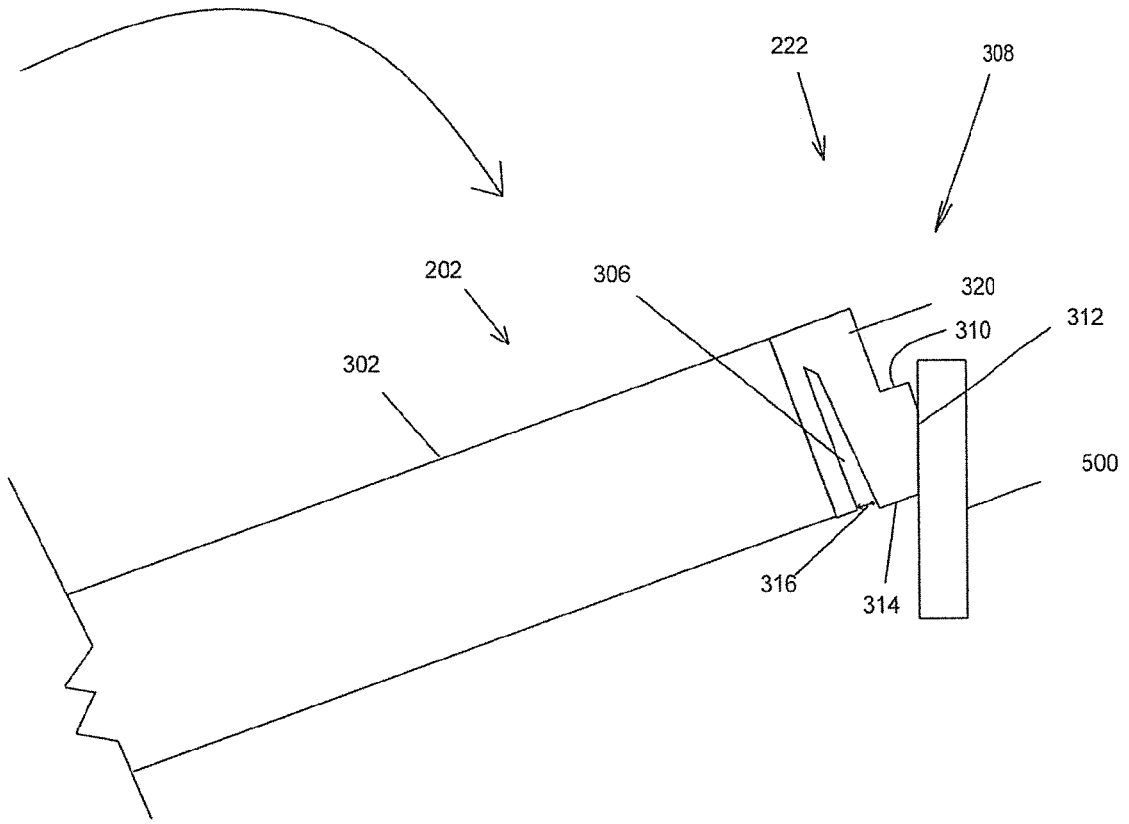
FIG. 4 is a side view of the vibratory shaker screen of FIG. 3 as the vibratory shaker screen is pivoting to an installation position.

Referring to FIG. 4, the tab 308 is shown during an installation wherein the first end 220 is located under a retainer while the remainder of the vibratory shaker screen 200 is pivoted toward a retainer 500 located within a vibratory shaker 109. Although illustrated as a straight or "flat" retainer 500 under which the tab 308 connects, it will be understood that other configurations are possible. One such possibility is a configuration with a hole within a side of a structural side member of the vibratory shaker 109. Such a hole would provide for entry of the lock surface 310 to an interior of the hole, thereby locking the vibratory shaker screen 200 into place. The hole may be a simple depression in the structural member, therefore eliminating a material escape path for materials being processed by the vibratory shaker 109. In other embodiments, the retainer 500 may be a ring configuration under which the tab 308 connects. In still other embodiments, the tab 308 may also have an upward flange extending from the lock surface 310 to engage the ring configuration.

An area defined by a depth 320 and the lock surface 310 on the tab 308 creates a contact surface with the retainer 500 of the vibratory shaker 109. In the embodiment illustrated, the amount of force of the weight of the vibratory shaker screen 200 during normal and high "g" loadings will not exceed the yield and bending strength of the materials within the vibratory shaker screen 200, such as in the tab connection area 318. As will be understood, the term "g" loading is defined as a multiple of the acceleration of gravity. To this end, normal operations of a vibratory shaker 109 mechanism will be approximately 6.5 "g" or times the acceleration of gravity. In some vibratory shakers 109, a second "peak" acceleration mode is provided. The peak acceleration mode is higher than the 6.5 "g". In one embodiment, the peak acceleration mode is approximately 7.5 "g". Other configurations having different "g" loading are possible. Service loading of the vibratory shaker screen 200 may be experienced from several force components, such as the weight of the vibratory shaker screens 200 themselves, the fluids transporting and impacting the structural members of the screen and solids impacting the screening material (mesh). When accelerations are added to these loads by the vibratory shaker 109, the amount of force that each vibratory shaker screen 200 experiences can be large. Since the amount of force can be large, the amount of contact between the tab 308 and the retainer 500 is provided such that material yield of the tab 308 does not occur. For larger loads, a greater lock surface 310 may be used to provide for loading in the "y" direction. For larger loads in the "x" direction, a larger cut out or depth 320 may be provided.

In one embodiment, numerous tabs 308 may be used on one vibratory shaker screen 200. Generally, at least two (2) tabs 308 are provided on each face of the mesh supporting system 202. In other embodiments, where a first side member 208 may be retained by both a top and bottom retainer 500, the tabs 308 may be omitted on the side that is retained by such a feature. As will be understood, the number of tabs 308 may vary according to the amount of mechanical connection desired to the vibratory shaker. Some side members of a vibratory shaker screen 200 may have no tabs 308, while other side members may have 1 or more tabs 308. In embodiments, the tabs 308 may be disposed across the length of screen, for example, directly in the center of the screen.

Referring to FIG. 4, the vibratory shaker screen 200 is being rotated into a fully installed position, shown in FIG. 5. In this embodiment of FIG. 4, the vibratory shaker screen 200, at a first end 220, is retained by a retainer 500 located on an inside wall of the shaker 109. With the first end 220 placed within the retainer 500, the second end 222 is rotated in a clockwise motion to allow for the second end 222 to engage a retainer 500 within the vibratory shaker 109 as shown in FIG. 5. As will be understood, such a configuration is merely one example. In another example, an alternative configuration is provided wherein the second end 222 may be inserted into a retainer 500 and a rotation of a counter-clockwise motion may be used with a tab 308 connecting to a retainer 500 on the vibratory shaker 109.

Although not shown, a structural support member may allow for limitation of travel such that the screen does not rotate an amount larger than necessary. In some embodiments, the tab 308 may also contact a portion of a retainer 500 after rotation is complete. In this embodiment, the forces in the "y" direction may be imparted into the bottom edge 314.

Referring to FIG. 5, the vibratory shaker screen 200 is illustrated in a fully engaged or installed condition. As illustrated, the rotation of the vibratory shaker screen 200 is complete and the lock surface 310 extends below the retainer 500 such that the lock surface 310 is engaged to a bottom surface of the retainer 500. The retainer 500 also contacts the depth 320 of the tab 308 to allow for "x" direction structural loading. Forces along the "x" axis are transferred from the depth to the tab connection area 318, as illustrated in FIG. 3. Vertical forces are transmitted as a sheer force at pivot point 324 as well as a moment with a moment arm of approximately the deflection area 316 plus the bottom edge 314 plus half of the lock surface 310 distance. In this installed position, the tab 308 is fully extended under the retainer 500 without deflection in direction 322, as illustrated in FIG. 3. In embodiments where a vibratory shaker 109 is processing materials out a front of the vibratory shaker 109, the vibratory shaker screens 200 may be slightly angled with an edge at the front of the vibratory shaker 109 at a lower elevation compared to a back of the vibratory shaker 109. In such a configuration, materials that enter the back of the vibratory shaker 109 are processed toward a front of the vibratory shaker 109, while drilling fluid gathers in a skid underneath the vibratory shaker 109. Then, dewatered materials, cuttings, exit from the front of the vibratory shaker 109. In other embodiments, final processing occurs out the back of the vibratory shaker 109, therefore, in these installations, the vibratory shaker screens 200 are slightly angled toward the rear. In each of the cases described, the slight change in elevation of the vibratory shaker screen 200 allows materials to flow to the respective lower end and exit the vibratory shaker 109.

In an embodiment, a tab 308 may be located on at least one retainer 500 of the vibratory shaker 109. The tab 308 may protrude from the retainer 500. In another embodiment, the tab 308 may have a depth 320, an angled surface 312, a lock surface 310 and a bottom edge 314. The tab 308 may engage the vibratory shaker screen 200 in the retainer 500 provided. The retainer 500 may be, for example, a hole within the mesh supporting system 202. In such a configuration, a first end of the vibratory shaker screen 200 may be positioned to engage a first tab 308 on the vibratory shaker 109. After positioning the vibratory shaker screen 200 with the tab 308 in the vibratory shaker screen 200, the vibratory shaker screen 200 may be rotated such that a second end of the vibratory shaker screen 200 is engaged by a second tab 308 on an opposite side of the vibratory shaker 109. In such an embodiment, more than one tab 308 may be used.

Although discussed above as a single tab connection, an entire vibratory shaker screen 200 may have multiple holes on each side, thus allowing a plurality of tabs 308 to be inserted into the vibratory shaker screen 200 at one time.

To provide for greater amounts of the lock surface 310, the angle of extension "α" may be increased. In the illustrated embodiment, the value "α" may be 120 degrees measured from the bottom edge 314 of the tab 308. Other embodiments for value "a" may be used. In other embodiments, tabs may be used not only on opposite side members, but also on all mesh support system 202 members of a s vibratory shaker screen 200.

Figure 6:
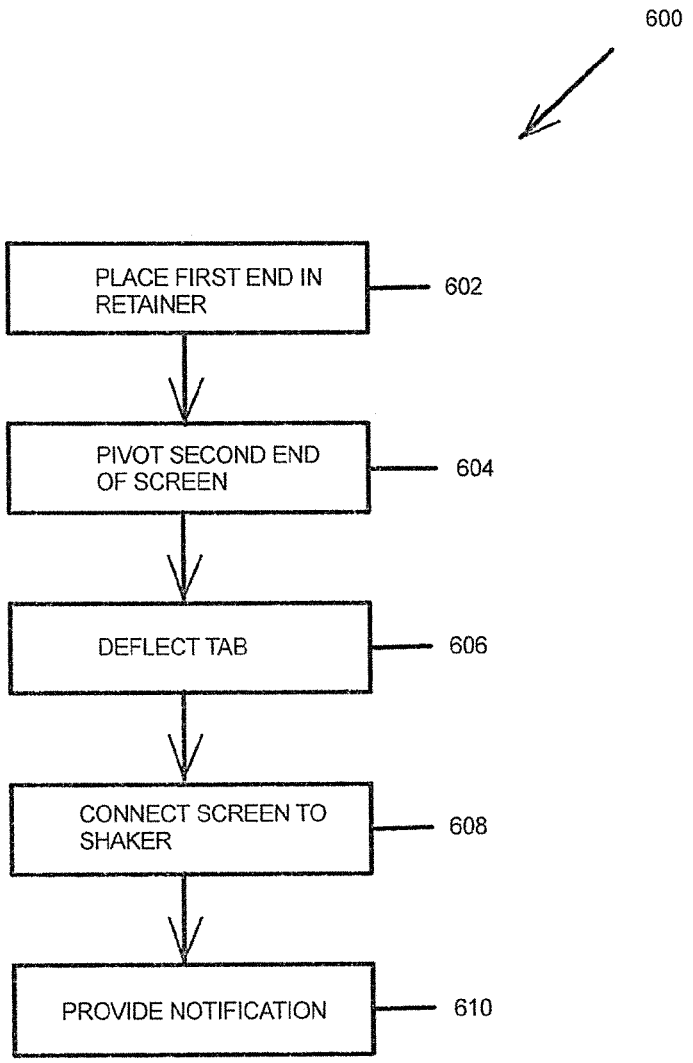
FIG. 6 is a method of installing a vibratory shaker screen in a vibratory shaker, according to one or more embodiments of the disclosure.

Referring to FIG. 6, a method 600 of installing a vibratory shaker screen in a vibratory shaker is disclosed. At 602, the method may comprise placing a first end of the vibratory shaker screen in a retainer, wherein the retainer is a component of the vibratory shaker. This retainer for the first end may be a fixed retainer with both a top edge and a bottom edge, and the entire vibratory shaker screen fits within the retainer. At 604, the method may comprise pivoting a second end of the vibratory shaker screen toward a screen installation position on the vibratory shaker. At 606, the method may further comprise deflecting a tab on the vibratory shaker screen and the vibratory shaker through contact of the vibratory shaker screen to another retainer of the vibratory shaker. At 608, the method may comprise connecting the screen to the vibratory shaker, wherein the tab is deployed such that the vibratory shaker screen cannot move without re-deflecting the tab connector. At 610, the method may also comprise providing a notification to an operator that the connecting of the screen to the vibratory shaker apparatus is successful. The notification provided to the operator may be a visual or auditory signal that a successful installation has occurred. In one embodiment, a sensor may be used to determine engagement of the tab 308 to the retainer and provide a light signal or sound signal that engagement has been achieved. In another embodiment, the sensor may be located within the shaker with the tab configured to actuate the sensor.

Figure 7:
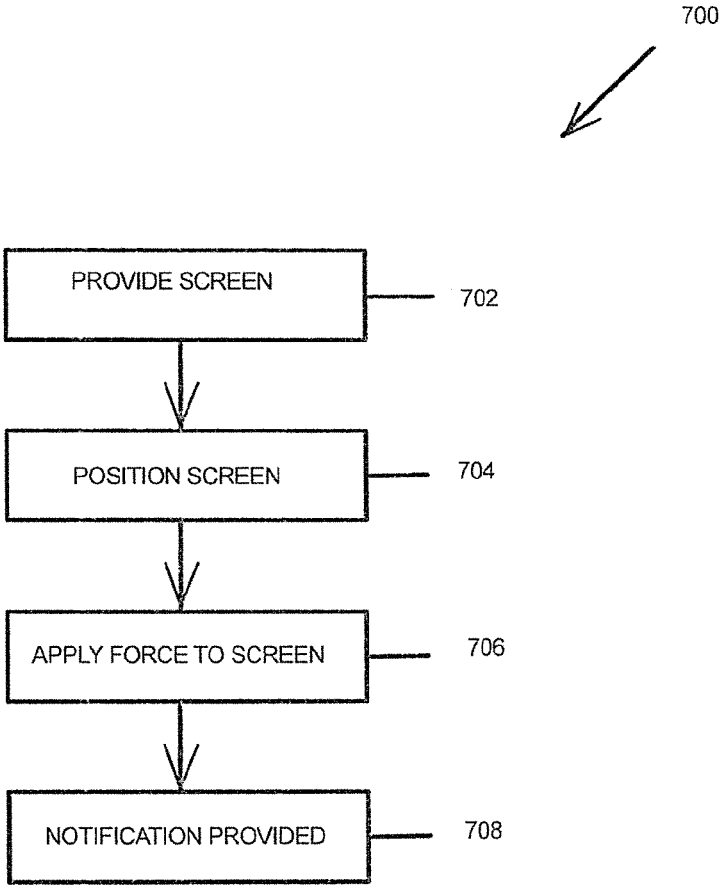
FIG. 7 is a method of installing a vibratory shaker screen in a vibratory shaker, according to one or more embodiments of the disclosure.
Figure 8:
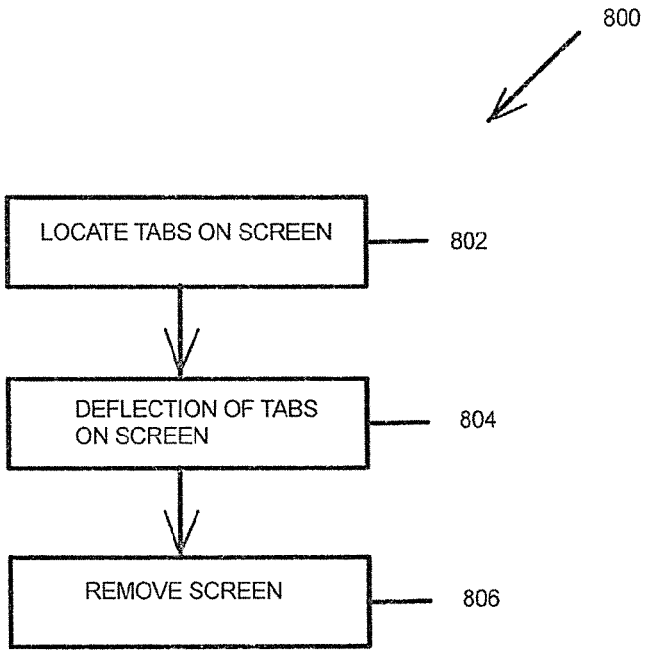
FIG. 8 is a method of disengaging a vibratory shaker screen located in a vibratory shaker, according to one or more embodiments of the disclosure.

As will be understood, as illustrated in FIG. 7, another method 700 of installation of a vibratory shaker screen may be performed. The vibratory shaker screen may be sized such that tabs on the vibratory shaker screen will deflect from a downward or "y" axis placement of force. Tabs located on each side of the vibratory shaker screen will deflect toward an "in-ward" position or deflected position, and then return to respective un-deflected positions once each tab encounters less resistance, such as an end of a retainer or a depression within the side of the vibratory shaker 109. At 702, the method may comprise providing a vibratory shaker screen with tabs. At 704, the method may comprise positioning the vibratory shaker screen over an area in the vibratory shaker where it is desired to process materials. At 706, the method may comprise applying a force to the vibratory shaker screen such that tabs are moved from an un-deflected position to a deflected position and moving the vibratory shaker screen such that each of the tabs engages a retainer. At 708, the method may also comprise generating a notification such that an operator may identify that each of the tabs has engaged an appropriate retainer. In this embodiment, the retainer may be on the screen 200 with the tabs deploying into the screen 200.

Removal of a vibratory shaker 200 screens may occur when a lock surface 310 is disengaged from its respective retainer 500. In an embodiment, the retainer 500 may be removed from a vibratory shaker 109. In another embodiment, an operator may access an area underneath an installed screen within the respective vibratory shaker screen and deflect the tab 308 on the screen such that the lock surface 310 no longer contacts the retainer 500. By using this method, the removal process is simplified and no use of hand tools is necessary. As provided in FIG. 8, a method 800 of removal of a vibratory shaker screen from a vibratory shaker is illustrated. At 802, the method may comprise locating tabs on the vibratory shaker screen, wherein the tabs are located in a non-deflected position. At 804, the method may further comprise placing a force on each tab of the vibratory shaker screen, such that the tab moves from a non-deflected position to a deflected position, wherein the deflected position entails a locking surface of the tab disengaging from a retainer. At 806, the method may also comprise removing the vibratory shaker screen from the vibratory shaker while the tabs are in the deflected position.

The above disclosure provides screening technology that allows for connection to a vibratory shaker system that will accept high forces during processing.

The above disclosure also provides a connection technology that will allow different types of vibratory shaker screens that are prone to damage to be removed from a vibratory shaker system such that processing of materials may continue.

The above disclosure further provides methodologies for connecting different types of vibratory shaker screens to vibratory shakers, wherein the methodologies are readily understandable by operators and involve a minimum of specialty tools.

The above disclosure also provides methods for disconnecting different types of screens to shakers, wherein the disconnecting process may be quickly performed, reducing maintenance costs.

In another embodiment, the method may be performed, wherein the notification is one of a visual identifier and an audible identifier.

In another embodiment, the vibratory shaker screen 200 may be configured wherein the tab 308 is configured with a defection area 316 between the tab 308 and a remainder of the mesh supporting system 202.

In another embodiment, the vibratory shaker screen 200 may be configured wherein at least one mesh portion is placed in the mesh supporting system 202, and the mesh supporting system 202 is made of one of a polymer, a metal and a composite material.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method of installing a vibratory shaker screen in a vibratory shaker, comprising:

placing a first end of the vibratory shaker screen in contact with a first retainer of the vibratory shaker;

pivoting a second end of the vibratory shaker screen toward a screen installation position on the vibratory shaker;

deflecting a tab on the vibratory shaker screen through contact of the vibratory shaker screen to a second retainer of the vibratory shaker during the pivoting; and connecting the vibratory shaker screen to the vibratory shaker, wherein the tab is positioned into a non-deflected position in contact with the second retainer such that the vibratory shaker screen is fixedly attached to the vibratory shaker.

2. The method of claim 1, further comprising transmitting a notification to an operator when the non-deflected position is achieved.

3. The method of claim 2, wherein the notification is a visual notification.

4. The method of claim 2, wherein the notification is an audible notification.

5. A vibratory shaker screen, comprising:

a mesh supporting system having at least one tab configured to move from an un-deflected position to a deflected position, the at least one tab configured to move to the deflected position upon placement of a force on the at least one tab, and the at least one tab further configured to return to the un-deflected position upon removal of the force; and at least one mesh portion disposed on the mesh supporting system, wherein the mesh supporting system has four side members, a top face, and a bottom face, and wherein the at least one tab has an angled surface and a bottom edge.

6. The vibratory shaker screen of claim 5, wherein the at least one tab is placed on one of the four side members.

7. The vibratory shaker screen of claim 5, wherein each of the four side members of the vibratory mesh supporting system has at least two tabs.

8. The vibratory shaker screen of claim 5, wherein the at least one tab is configured with a deflection area between the at least one tab and a remainder of the mesh supporting system.

9. The vibratory shaker screen of claim 5, wherein the at least one tab has a depth and a lock surface, and both the depth and the lock surface are configured to abut a retainer of a vibratory shaker.

10. The vibratory shaker screen of claim 9, wherein the depth and the lock surface are configured at 90 degrees.

11. The vibratory shaker screen of claim 5, wherein the at least one mesh portion is made of a metal.

12. The vibratory shaker screen of claim 5, wherein the at least one mesh portion is made of one of a polymer and a composite material.

13. The vibratory shaker screen of claim 5, wherein the at least one mesh portion is connected to the top face.

14. The vibratory shaker screen of claim 13, wherein the at least one tab is positioned on one of the four side members of the mesh supporting system.

15. A vibratory shaker screen, comprising:

a mesh supporting system having a top face and a bottom face, the mesh supporting system forming a frame with at least one side of the frame having at least one tab configurable in an un-deflected position and a deflected position, wherein each of the at least one tab is configured to deflect upon placement of a force upon the tab and is further configured to return to the un-deflected position upon removal of the force, and wherein the mesh supporting system has a top face and a bottom face;

a first mesh portion connected to the top face of the mesh supporting system; and a second mesh portion connected to the bottom face of the mesh supporting system, wherein the at least one tab has an angled exterior surface and a bottom edge, and the tab is configured from portions of the frame.

16. The vibratory shaker screen of claim 15, wherein the frame is tubular.

17. The vibratory shaker screen of claim 15, wherein the frame has a first side and a second side and at least one structural element extending from the first side to the second side.

18. The vibratory shaker screen of claim 15, wherein the first mesh portion and the second mesh portion are configured in a wave form.

19. A method of installing a vibratory shaker screen in a vibratory shaker, comprising:

placing a first end of a vibratory shaker screen in contact with a vibratory shaker;

placing a second end of the vibratory shaker screen in contact with the vibratory shaker;

applying a force onto the vibratory shaker screen to deflect at least one tab on one of the vibratory shaker screen and the vibratory shaker; and connecting the vibratory shaker screen to the vibratory shaker, wherein the at least one tab is positioned into a non-deflected position such that the vibratory shaker screen is fixedly attached to the vibratory shaker.

20. The method according to claim 19, wherein the force applied to the vibratory shaker screen is a vertical force.

21. The method according to claim 19, wherein the at least one tab is on the vibratory shaker screen.

22. The method according to claim 19, wherein the at least one tab is on the vibratory shaker.

* * * * *